US008334776B2

(12) United States Patent
Yang

(10) Patent No.: US 8,334,776 B2
(45) Date of Patent: Dec. 18, 2012

(54) ELECTRONIC ARTICLE SURVEILLANCE CARRIER AND TAG

(76) Inventor: Xiao Hui Yang, Los Altos, CA (US)

( * ) Notice: Subject to any disclaimer, the term of this patent is extended or adjusted under 35 U.S.C. 154(b) by 415 days.

(21) Appl. No.: 12/815,380

(22) Filed: Jun. 14, 2010

(65) Prior Publication Data

US 2010/0315239 A1 Dec. 16, 2010

Related U.S. Application Data

(60) Provisional application No. 61/186,889, filed on Jun. 14, 2009.

(51) Int. Cl.
*G08B 13/14* (2006.01)

(52) U.S. Cl. ..... 340/572.9; 340/572.1; 340/10.1

(58) Field of Classification Search ..... 340/572, 340/505, 10

See application file for complete search history.

(56) References Cited

U.S. PATENT DOCUMENTS

| | | | | |
|---|---|---|---|---|
| 4,772,878 | A | 9/1988 | Kane | |
| 5,565,848 | A | 10/1996 | Leyden et al. | |
| 5,570,080 | A | 10/1996 | Inoue et al. | |
| 5,589,819 | A | 12/1996 | Takeda | |
| 6,104,289 | A | 8/2000 | Rand | |
| 6,237,375 | B1 * | 5/2001 | Wymer | 70/14 |
| 6,255,958 | B1 | 7/2001 | Haimovich et al. | |
| 6,353,389 | B1 | 3/2002 | Matsuo | |
| 6,995,674 | B2 | 2/2006 | Turner et al. | |
| 7,015,815 | B1 | 3/2006 | Feibelman | |
| 7,190,272 | B2 | 3/2007 | Yang et al. | |
| 7,400,254 | B2 * | 7/2008 | Yang et al. | 340/572.1 |
| D578,030 | S | 10/2008 | Yang et al. | |
| 7,474,222 | B2 * | 1/2009 | Yang et al. | 340/572.8 |
| 7,497,101 | B2 * | 3/2009 | Fawcett et al. | 70/57 |
| D599,242 | S | 9/2009 | Yang | |
| 7,623,039 | B2 | 11/2009 | Liu | |
| 7,737,843 | B2 | 6/2010 | Belden, Jr. et al. | |
| 8,144,014 | B1 * | 3/2012 | Yang | 340/572.1 |
| 2006/0250241 | A1 * | 11/2006 | Renzetti et al. | 340/572.1 |
| 2009/0033497 | A1 | 2/2009 | Wyatt et al. | |
| 2009/0289798 | A1 * | 11/2009 | Yang | 340/572.8 |
| 2010/0171621 | A1 * | 7/2010 | Yang | 340/572.9 |
| 2010/0214102 | A1 * | 8/2010 | Yang | 340/572.9 |
| 2011/0115632 | A1 * | 5/2011 | Yang | 340/572.8 |
| 2011/0121973 | A1 * | 5/2011 | Yang | 340/572.8 |
| 2011/0227706 | A1 * | 9/2011 | Yang | 340/10.1 |
| 2011/0260594 | A1 * | 10/2011 | Yang | 312/297 |

* cited by examiner

*Primary Examiner* — Travis Hunnings
(74) *Attorney, Agent, or Firm* — Robert R. Waters; Brian W. Foxworthy; Waters Law Group, PLLC

(57) ABSTRACT

An electronic article surveillance (EAS) apparatus is comprised of a carrier and an EAS unit. The carrier receives the EAS unit and has an adhesive element on one of its surfaces to attach to an item to be protected. The EAS unit may have several electronic components including, among others, an EAS coil, a microprocessor, communication elements, a switch, a battery, and an audible alarm generator. The EAS unit can be removed from a protected item by opening, or parting, the carrier. Once the carrier is opened the EAS unit can be retrieved for reuse. External devices can be used to communicate with and disarm the EAS unit. If an EAS unit is removed without being disarmed, a switch detects the change in status and an audible alarm is generated.

39 Claims, 5 Drawing Sheets

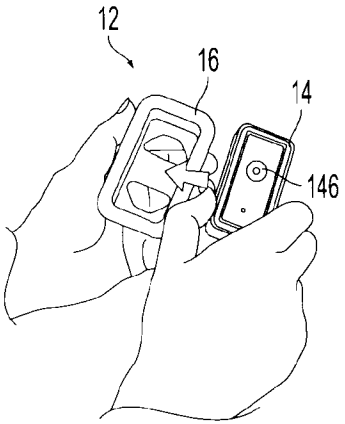
FIG. 14
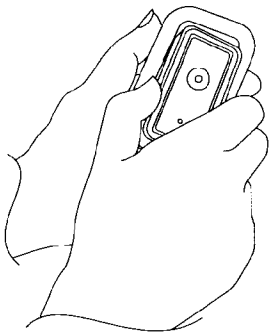
FIG. 15
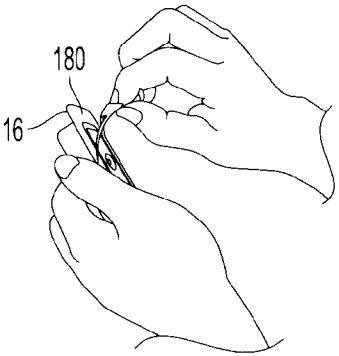
FIG. 16
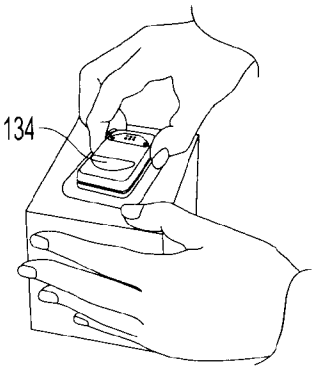
FIG. 17
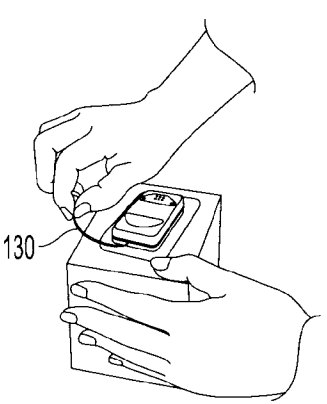
FIG. 18
FIG. 19
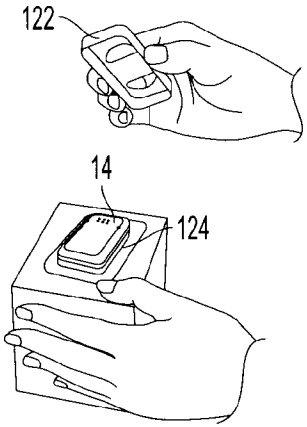
FIG. 20
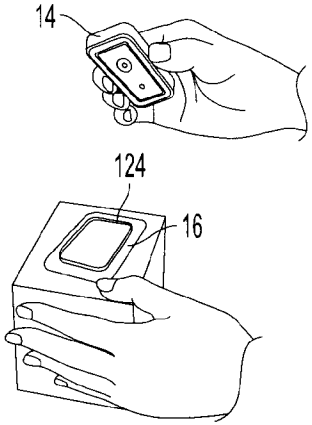
FIG. 21

ELECTRONIC ARTICLE SURVEILLANCE CARRIER AND TAG

CROSS REFERENCE TO RELATED APPLICATIONS

This application claims priority to U.S. Provisional Application 61/186,889 filed on Jun. 14, 2009. The entire disclosure contained in U.S. Provisional Application 61/186,889, including the attachments thereto, are incorporated herein by reference.

FIELD OF THE INVENTION

This application describes and/or claims certain embodiments of the invention pertaining to an electronic article surveillance carrier and an electronic article surveillance tag and system.

BACKGROUND OF THE INVENTION

Electronic article surveillance systems have been used for many years as a means of deterring retail shoplifting in clothing stores, electronic stores, and a myriad of other retail establishments. Generally speaking, an EAS system will begin with a tag, consisting of a durable and reliable, yet small, sensor tag which is affixed to the article to be detected in such a way that it cannot be easily removed by a customer in the store. Usually, the system depends upon the feature that the attachment mechanism is constructed such that it can only be removed by the use of a specialized tool which is only in the possession of the store personnel at the checkout register or exit port for the establishment. In the event that an EAS tag is not removed from a protected article prior to exiting the store, an alarm or other signal is activated.

In many commercially available EAS systems, one or more antennas are placed at the exits and entrances to the retail location. These antennas set up zones, sometimes referred to as interrogation zones, in which an EAS tag (or marker) may be sensed. At least one antenna serves the function of sending out what is called an interrogation signal. The markers on the merchandise are affected by this signal and will respond with a signal of their own. Either the same antenna that sends out the interrogation signal or other additional antennas can sense the signals from the markers. The most effective way to do this is by stopping the broadcast of the interrogation signal to listen for the signals emanating from the markers. If a marker is sensed within the zone created by the antennas, it is presumed that an article is being removed without purchase, and alarms are set off. These alarms may be audible alarms for general broadcast or the alarms may be silent alarms in the form of a light at a check-out counter or security station, etc.

In order to make an EAS system effective, one must consider how to make the EAS tags tamper resistant. This is an on-going effort, because over time, thieves become more clever in learning how to tamper with an EAS tag such as to defeat it. The retailer (and the tag manufacturer) must consider how to detect and prevent tampering with the tags. The particular construction of a tag will determine how tampering is detected.

SUMMARY

In one embodiment, an electronic article surveillance tag comprises a carrier comprising a housing having an interior void, a frangible tab disposed along the housing and a means for attaching the housing to an article. The tag further includes an electronic article surveillance unit.

In another embodiment, an electronic article surveillance tag comprises a carrier comprising a housing having an interior void, a pull-seal tab disposed along the housing and a means for attaching the housing to an article to be protected. The tag further includes an electronic article surveillance unit.

In another embodiment, the housing may comprise an upper housing, a lower housing, and an edge between the upper housing and the lower housing, the housings and the edge defining the interior void.

In another embodiment, the housing may comprise a first half having a margin and a second half having a margin, the first half mutually communicating with the second half along the respective margins.

In one embodiment, the tab is removable from the housing by pulling and generating a fracture.

In another embodiment, the tab is removable from the housing by pulling along one or more frangible score lines provided on the housing.

BRIEF DESCRIPTIONS OF THE DRAWINGS

Figure 1:
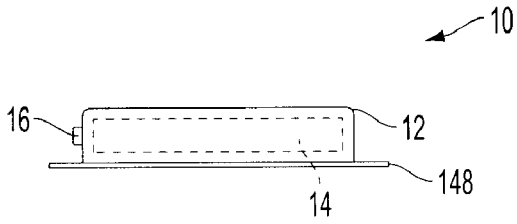
FIG. 1 is a side view of an EAS tag made according to one embodiment of the invention.
Figure 4:
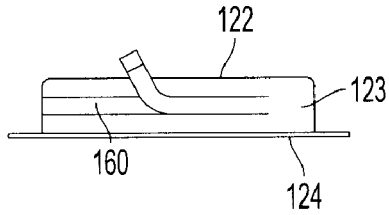
FIG. 4 is a side view of a tab pulled to create a fracture along the edge of the carrier.
Figure 2:
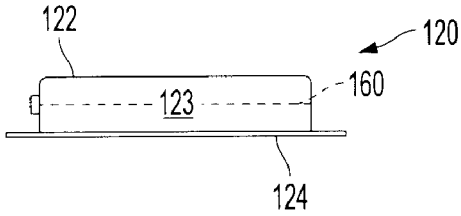
FIG. 2 is a side view of an EAS tag with a tab for removing one part of the tag carrier from another part of the tag carrier.
Figure 5A:
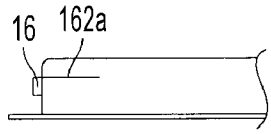
Figure 5B:
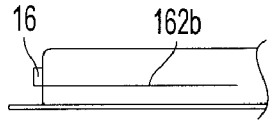
Figure 3:
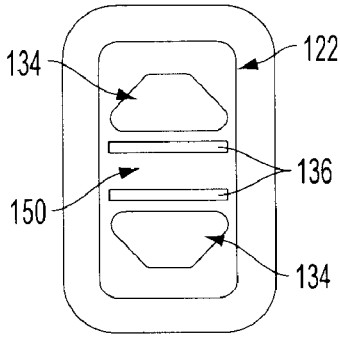
FIG. 3 is an underside view of an upper housing or first half of an EAS tag carrier.
Figure 5C:
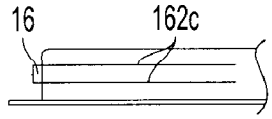

FIG. 5*a* through FIG. 5*c* are side views of various lengths and numbers of frangible score lines placed in the edge of the carrier.

Figure 6:
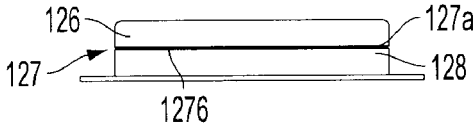

FIG. 6 is a side view of another embodiment of an EAS tag having two halves engaging along a seam formed by the respective margins of the halves.

Figure 7:
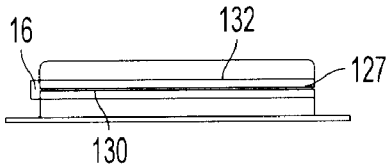

FIG. 7 is a side view of the embodiment depicted in FIG. 6.

Figure 8:
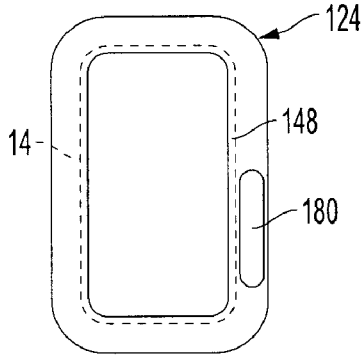

FIG. 8 is an underside view of a lower housing or second half of an EAS tag carrier.

Figure 9:
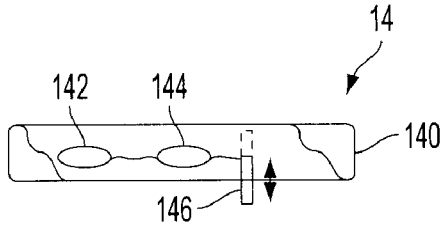

FIG. 9 is a side view with a removed portion of the housing shell, the view depicting the inner elements of an EAS unit.

Figure 10:
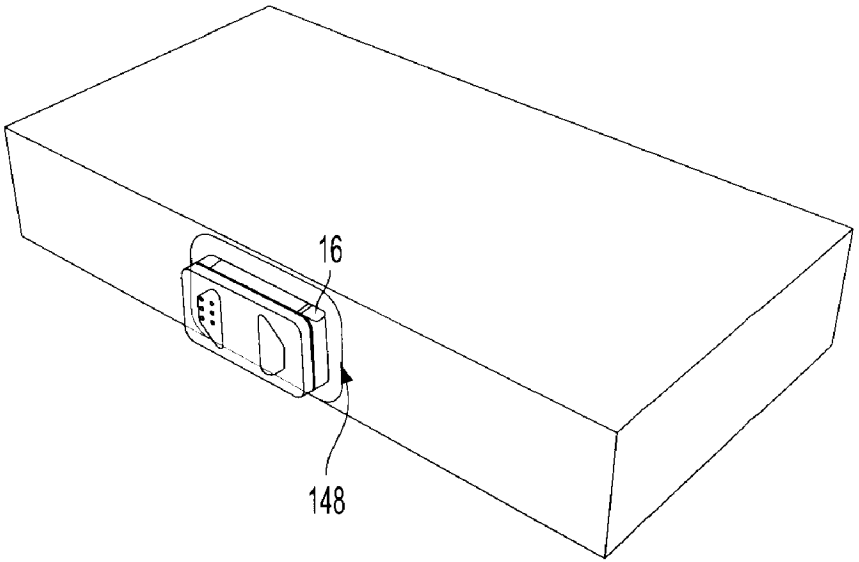

FIG. 10 is a perspective view of an embodiment of the electronic article surveillance apparatus installed on an item to be protected.

Figure 11:
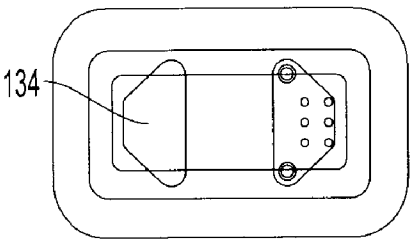

FIG. 11 is a top view of an embodiment of the electronic article surveillance apparatus.

Figure 12:
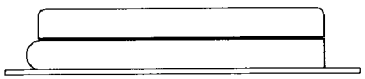

FIG. 12 is a side view of an embodiment of the electronic article surveillance apparatus.

Figure 13:
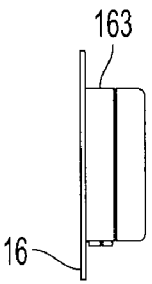

FIG. 13 is an end view of an embodiment of the electronic article surveillance apparatus.

FIG. 14-FIG. 21 show an embodiment of the electronic article surveillance apparatus in use.

Figure 22:
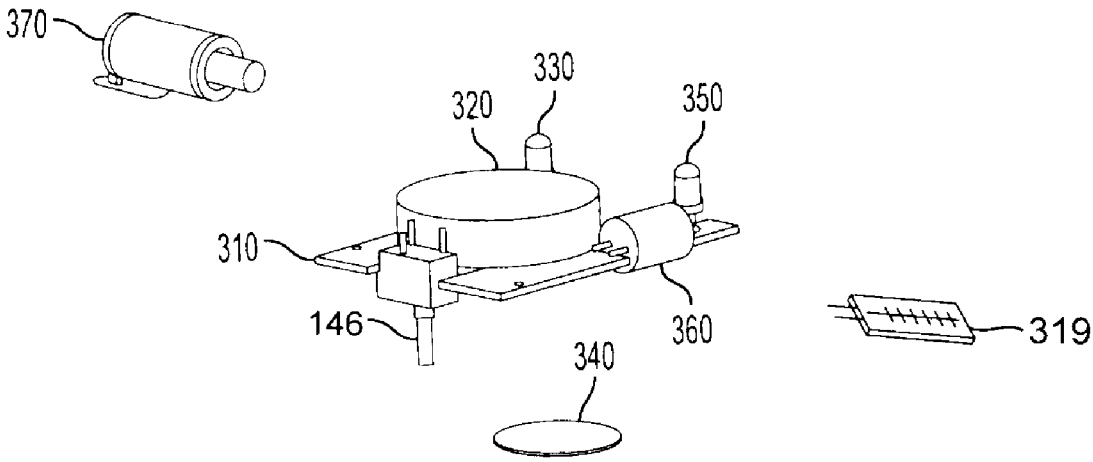

FIG. 22 shows the several electronic components that may be present in different embodiments of the electronic article surveillance apparatus.

DESCRIPTION OF THE EMBODIMENTS

Referencing FIG. 1 through FIG. 21, an electronic article surveillance ("EAS") tag, or apparatus, is depicted, generally denoted by reference character 10. The EAS apparatus 10 may comprise a carrier 12 and an EAS unit 14. The carrier 12 may include a removable tab 16 disposed thereon for dividing the housing 12 into multiple parts to facilitate permissible removal of the EAS unit 14 from the EAS tag 10. The carrier 12 may include a housing 120 having an interior void 150, the void 150 receiving the EAS unit 14 therein. The carrier 12 may be attached or affixed to an item or object to be protected by a variety of articles or devices, including adhesives or mechanical fasteners among the options envisioned.

In one embodiment of the invention, the housing 120 may comprise an upper housing 122, a lower housing 124 and an edge 123 between the upper housing 122 and the lower housing 124. The housings 122 and 124 and the edge 123 define the interior void 150 of the housing 120. The void 150 accommodates and retains the EAS unit 14. In an embodiment of this type, the tab 16 is disposed along the edge 123. Pulling the tab 16 generates a fracture 160 along the edge 123.

At least two embodiments of the tab 16 are envisioned. In one embodiment, the tab 16 is frangibly connected to the edge 123 by a frangible portion comprising a weakened or reduced strength design of the material used to fabricate the housings 122 and 124 and edge 123, respectively. A person (or device, apparatus or machine) may grasp and pull the tab 16 along a path corresponding to the edge 123, with the force imparted (on the tab 16 and edge 123 material) sufficient to generate a fracture 160 along the edge 123, thereby separating housings 122 and 124.

In a variation of the aforementioned embodiment, the tab 16 may include one or more frangible score lines 162*a*, 162*b*, or 162*c* (e.g. FIG. 5*a*, FIG. 5*b*, and FIG. 5*c*, respectively), which may be placed in the edge 123 by molding or machining. The frangible score lines 162*a*, 162*b*, or 162*c* may include a range of lengths from a minimal length (e.g. FIG. 5*a*) to at least one side of edge 123 (e.g. FIGS. 5*c* and 162*c*), if not circumscribing the entire edge 123, as well as lengths therebetween (e.g. FIGS. 5*b* and 162*b*).

In another embodiment of the invention, the housing 120 may comprise a first half 126 having a margin 127*a* and a second half 128 having a margin 127*b*, the first half 126 mutually communicating with the second half 128 along the respective margins 127*a* and 127*b*. The margins 127*a* and 127*b* form a seam 127. In one embodiment, a frangible band 130 depends from the tab 16, the band 130 communicating with the seam 127 formed and defined by the margins 127*a* and 127*b*. The band 130 may include one or more frangible score lines 132 of variable length, from a minimal length to circumscribing the entire seam 127 formed by the margins 127*a* and 127*b*.

At least one window 134 may be disposed in the upper housing 122 or the first half 126. It is further envisioned that a plurality of windows 134 may be disposed in the upper housing 122 or the first half 126. The window(s) 134 may be provided to permit users or operators to view the EAS unit 14 housed therein. The window(s) 134 may also be provided to facilitate removal of the EAS unit 14 once the housings 122 and 124, or the halves 126 and 128, are separated from one another during the deactivation process. For example, if the EAS unit 14 does not separate from the upper housing 122 or first half 126, then a user or operator may forcibly press on the EAS unit 14 through one of the ports 134 provided, thereby dislodging the EAS unit 14 from the supporting carrier 12 element.

A quantity of adhesive 136 may be applied to interior void 150 or to the top surface of the EAS unit 14, or both, to temporarily but removably retain EAS unit 14 within the carrier 12 structure. The addition of the adhesive 136 inhibits excessive movement of the unit 14, as well as cooperatively working with the flange 148 (described below) to counteract any opposing force imparted by the plunger(s) 170 (described below) used in the EAS unit 14. Furthermore, the adhesive 180 may aid in reducing any physical damage that may result from the removal of the EAS unit 14 from the carrier 12 structure. For example, once the upper housing 122 or first half 126 is separated from its respective mate (e.g. lower housing 124 or second half 128, respectively), the EAS unit 14 may be separated from the housing 120 and fall to a surface or into an object, thereby physically damaging the EAS unit 14 and preventing recovery and recycled use. With the adhesive in place, the EAS unit 14 may be retained sufficiently long enough for the user or operator to retrieve the EAS unit 14, undamaged, and place it with other recovered EAS units 14 for recycling with other carrier 12 structures in the future.

A flange 148 may be disposed along the lower housing 124 or second half 128, respectively, forming a skirt along the underside of the housing 124 or half 128. An adhesive element 180 (similar to or different from adhesive above) may be applied to an underside surface of the flange 148, the adhesive element conjoining the housing 124 or half 128 to the article or object to be protected by the EAS unit and system. In another embodiment, a strip of adhesive 180 may be applied. In another embodiment, the strip of adhesive 180 may include a removable backing.

Usually, the article or object to which the carrier 12 structure is applied may comprise the retail article for sale (if unpackaged), or the packaging in which the retail article is provided, such as thin thermoplastic wrappings, packaging comprising thermoplastic, plastic, cardboard, wood or metal materials, or a combination thereof.

The EAS unit 14 comprises an EAS unit housing 140 that houses an active element 142, an on-board and self-contained alarm 144 and at least one plunger switch 146. The active element 142 may comprise a variety of devices or articles, including ferrite (mechanically resonate material combinations, such as a bias material and resonator) materials, infrared (IR) elements, and/or radio frequency identification (RFID) elements. Generally, the aforementioned materials generate signals or information relayed to antenna(e) or other receiver stations, such that when active (and not manually or automatically deactivated by the retailer before exit), the unit 14 will activate a store-installed alarm signaling an active or live unit has impermissibly entered an interrogation zone. These separate devices or articles are generally known in the art.

At least one plunger switch 146, and as envisioned, a plurality of plunger switches 146, may be provided through associated openings in the underside of the unit housing 140. The plunger switch(es) 146 may be outwardly biased via a spring or other mechanism so that when deployed in its outwardly biased and extended state, through electrical coupling with the on-board alarm 144 and/or signal generating element (s), the on-board alarm 144 and separate system alarm are actuated. The EAS unit 14 is placed into the carrier 12, the plunger switch(es) 146 is depressed into a retracted state, with a surface (generally the exterior surface of the object, article or packaging for the object/article) providing resistance against the plunger switch(es) 146 and inhibits alarm actuation. If the tab 16 and/or band is loosened or removed before deactivation, and the EAS unit 14 is displaced from the surface with which it is generally in contact, the plunger switch (es) 146 will return to an extended and deployed position, thereby actuating the alarm(s) associated therewith, and signaling to retail employees that the retail article maybe the target of a theft or tampering. Because the plunger switche (es) 146 is/are electrically and operatively integrated with the alarm(s), once the EAS unit 14 is deactivated by a retail employee at point of sale, the plunger switch(es) 146 have no impact when released, thus the alarm(s) will not sound. However, if a person attempts to transport a protected retail article outside of the retail premises, without removing the adhesive and tag, the EAS unit 14 will activate the antenna(e) or station (s) as well as activating the self-alarm 144 provided on-board the unit 14.

The apparatus 10, and its various embodiments described above, is envisioned for utilization in an electronic article surveillance system comprising at least one electronic article surveillance tag 10, at least one deactivating device, and at least one transmission antenna that creates an interrogation zone. The tag 10 may generally take the form of one or more of the embodiments, including combinations and sub-combinations of the various elements and alternatives described above. A deactivating device may comprise a variety of devices or apparatuses, such as those associated with mechanically resonant materials, IR and RFID configurations, or known in the art.

Generally, the antenna(e) is/are devices that generate a signal or signals near a store's exit. The signal(s) are cast into an area generally defined as an interrogation zone. An active tag, having a signal being transmitted for detection by an antenna or antennae, entering the interrogation zone will activate one or more interoperable alarms associated with the particular system. The alarm(s) will continue to sound until deactivated by retail personnel.

FIG. 22 shows the several electronic components that may be present in different embodiments of the electronic article surveillance apparatus, in particular in the electronic article surveillance unit part of the apparatus. A circuit board 310 provides a mount for several components including: microprocessor 320, infrared communication port 330, plunger switch 146, battery 360, audible alarm generator 340, and radio frequency communication circuits 319. In FIG. 22, audible alarm generator 340 and radio frequency communication circuits 319 are shown detached from the rest of the electronic components, but in use, would be connected. Infrared communication port 330 and radio frequency communication circuits 319 provide communication capabilities to electronic article surveillance (EAS) unit 14, and depending on the application, one or both types of communication elements may be present. Plunger switch 146 can detect when EAS unit 14 is being removed from an item and audible alarm generator 340 generates an alarm when EAS unit 14 is removed without authorization. External devices can communicate with EAS unit 14 to disarm it, either to authorize the removal of EAS unit 14 or to disarm it once it is alarming to turn of the audible alarm. Battery 360 powers the electronic components, while microprocessor 320 is programmable and coordinates the functions of the other elements.

In some embodiments of the electronic article surveillance apparatus, the electronic components will not need a battery to actively respond to an EAS system. EAS ferrite 370 is energized while in an electromagnetic field, sometimes called an interrogation field, and when the field is removed, the energy in EAS ferrite 370 is dissipated, creating a signal which can be detected by an EAS system.

Referring to FIGS. 14 through 21, an embodiment of the electronic article surveillance apparatus is shown in use protecting an item. In FIGS. 14 and 15, a user is placing an EAS unit 14 into a carrier 12. Plunger switch 146 can be seen in FIGS. 14 and 15. In FIG. 16, a cover is being pealed off to expose adhesive element 180 on the bottom of flange 16. In FIG. 17, the apparatus is placed on an item to be protected and is held in place by the adhesive element. In the position, plunger switch 146 is depressed, arming the device. The EAS tag is now installed. Window 134 allows infrared communication between the EAS apparatus and an external device.

FIGS. 18 through 21 show the EAS apparatus being disabled and removed from the item to be protected. In FIG. 18, an external device is used to communicate with EAS unit 14 through window 134 (labeled in FIG. 17) and disarm the alarming functions of the unit. In FIG. 19, frangible band 19 is pulled from around the joint between upper housing 122 and lower housing 124. In FIG. 20, upper housing 122 is removed from lower housing 124, exposing EAS unit 14. In FIG. 21, EAS unit 14 is removed from the item. Once removed, EAS unit 14 may be coupled with another carrier 12 and reused. This allows the higher value component of the apparatus to be reused repeatedly, while providing ease of removal once the EAS unit is disarmed. The use of an adhesive provides a simple method of attachment to many articles.

It is further envisioned that methods for deactivating the EAS unit 14 in the EAS apparatus 10, as well as methods for operating an EAS system incorporating the apparatus 10 described above in its various embodiments, combinations and sub-combinations, are capable of being performed from the descriptions provided above.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciated that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. An electronic article surveillance apparatus, comprising:

an electronic article surveillance unit, an enclosure comprised of an attaching portion and a removable portion, said attaching portion having a contact surface with an adhesive element on it for attaching said enclosure to an item to be protected, said contact surface having an aperture for receiving said electronic article surveillance unit into said enclosure;

said removable portion being removably joined to said attaching portion at a joint to form said enclosure.

2. The electronic article surveillance apparatus of claim 1, further comprising:

a removable adhesive strip overlaying said joint along a portion of the length of said joint.

3. The electronic article surveillance apparatus of claim 1, wherein:

said joint comprises a frangible portion between said attaching portion and said removable portion.

4. The electronic article surveillance apparatus of claim 3, wherein:

said frangible portion comprises a pull tab.

5. The electronic article surveillance apparatus of claim 1, wherein:

said electronic article surveillance unit comprises a ferrite electronic article surveillance element.

6. The electronic article surveillance apparatus of claim 1, wherein:

said electronic article surveillance unit comprises a resonator electronic article surveillance element.

7. The electronic article surveillance apparatus of claim 1, wherein:

said electronic article surveillance unit is reusable.

8. The electronic article surveillance apparatus of claim 1, further comprising:

adhesive on the interior of said enclosure.

9. The electronic article surveillance apparatus of claim 1, wherein:

said electronic article surveillance unit comprises a battery, an audible alarm generator, and a switch, said switch contacting said item to be protected when the electronic article surveillance apparatus is installed on said item to be protected.

10. The electronic article surveillance apparatus of claim 9, wherein:

said electronic article surveillance unit further comprises at least one communication element and a microprocessor capable of storing and executing machine readable instructions.

11. The electronic article surveillance apparatus of claim 10, wherein:

said at least one communication element is radio frequency circuitry.

12. The electronic article surveillance apparatus of claim 10, wherein:

said at least one communication element is an infrared communication port, and said carrier has at least one window permitting infrared communication between said electronic article surveillance unit and an external device.

13. The electronic article surveillance apparatus of claim 10, further comprising:

machine readable instructions encoded in said microprocessor for storing a passcode.

14. The electronic article surveillance apparatus of claim 13, wherein:

said electronic article surveillance unit further comprises an accurate clock generator, and said machine readable instructions further comprise an algorithm for generating multiple passcodes, wherein at specific time intervals said algorithm generates a new passcode and a previously stored passcode is replaced by said new passcode.

15. The electronic article surveillance apparatus of claim 1, further comprising:

a pull tab to facilitate the removal of said removable portion from said attaching portion.

16. An electronic article surveillance apparatus, comprising:

an electronic article surveillance unit, and an enclosure having a contact surface and one or more exposed surfaces, said contact surface having an adhesive element on it for attaching said enclosure to an item to be protected and said contact surface having an aperture for receiving said electronic article surveillance unit into said enclosure, at least one of said one or more exposed surfaces having at least one parting score to facilitate parting of said at least one of said one or more exposed surfaces to remove said electronic article surveillance unit from said item to be protected.

17. The electronic article surveillance apparatus of claim 16, wherein:

said electronic article surveillance unit comprises a ferrite electronic article surveillance element.

18. The electronic article surveillance apparatus of claim 16, wherein:

said electronic article surveillance unit comprises a resonator electronic article surveillance element.

19. The electronic article surveillance apparatus of claim 16, wherein:

said electronic article surveillance unit is reusable.

20. The electronic article surveillance apparatus of claim 16, further comprising:

adhesive on the interior of said enclosure.

21. The electronic article surveillance apparatus of claim 16, wherein:

said electronic article surveillance unit comprises a battery, an audible alarm generator, and a switch, said switch contacting said item to be protected when the electronic article surveillance apparatus is installed on said item to be protected.

22. The electronic article surveillance apparatus of claim 21, wherein:

said electronic article surveillance unit further comprises at least one communication element and a microprocessor capable of storing and executing machine readable instructions.

23. The electronic article surveillance apparatus of claim 22, wherein:

said at least one communication element is radio frequency circuitry.

24. The electronic article surveillance apparatus of claim 22, wherein:

said at least one communication element is an infrared communication port, and said carrier has at least one window permitting infrared communication between said electronic article surveillance unit and an external device.

25. The electronic article surveillance apparatus of claim 22, further comprising:

machine readable instructions encoded in said microprocessor for storing a passcode.

26. The electronic article surveillance apparatus of claim 25, wherein:

said electronic article surveillance unit further comprises an accurate clock generator, and said machine readable instructions further comprise an algorithm for generating multiple passcodes, wherein at specific time intervals said algorithm generates a new passcode and a previously stored passcode is replaced by said new passcode.

27. The electronic article surveillance apparatus of claim 16, further comprising:

a pull tab to further facilitate the parting of said at least one of said one or more exposed surfaces to remove said electronic article surveillance unit from said item to be protected.

28. An electronic article surveillance apparatus, comprising:

a carrier comprising a top panel, a flange, and one or more sides, said top panel comprising a top surface, a bottom surface and one or more edges, said flange having a top surface, a bottom surface with an adhesive element on it, and an aperture having one or more edges and generally matching the size and shape of said top panel, said bottom surface of said flange being adhesively attachable to an item to be protected, one of said one or more sides attaching to the bottom surface of said panel at one of said one or more edges of said top panel, extending to a respective one of said one or more edges of said aperture in said flange and attaching to said top surface of said flange, each said one or more sides having a parting score between said top panel and said flange, said top panel and said one or more sides defining a void, and;

an electronic article surveillance unit sized and shaped to fit in said void, wherein;

said parting score in each said one or more sides allows said top panel and adjoining sections of said one or more sides to be separated from said flange and adjoining sections of said one or more sides to allow removal of said at least one electronic article surveillance unit from an item being protected.

29. The electronic article surveillance apparatus of claim 28, wherein:

said electronic article surveillance unit comprises a ferrite electronic article surveillance element.

30. The electronic article surveillance apparatus of claim 28, wherein:

said electronic article surveillance unit comprises a resonator electronic article surveillance element.

31. The electronic article surveillance apparatus of claim 28, wherein:

said electronic article surveillance unit is reusable.

32. The electronic article surveillance apparatus of claim 28, further comprising:

adhesive on the interior of said carrier.

33. The electronic article surveillance apparatus of claim 28, wherein:

said electronic article surveillance unit comprises a battery, an audible alarm generator, and a switch, said switch contacting said item to be protected when the electronic article surveillance apparatus is installed on said item to be protected.

34. The electronic article surveillance apparatus of claim 33, wherein:

said electronic article surveillance unit further comprises at least one communication element and a microprocessor capable of storing and executing machine readable instructions.

35. The electronic article surveillance apparatus of claim 34, wherein:

said at least one communication element is radio frequency circuitry.

36. The electronic article surveillance apparatus of claim 34, wherein:

said at least one communication element is an infrared communication port, and said carrier has at least one window permitting infrared communication between said electronic article surveillance unit and an external device.

37. The electronic article surveillance apparatus of claim 34, further comprising:

machine readable instructions encoded in said microprocessor for storing a passcode.

38. The electronic article surveillance apparatus of claim 37, wherein:

said electronic article surveillance unit further comprises an accurate clock generator, and said machine readable instructions further comprise an algorithm for generating multiple passcodes, wherein at specific time intervals said algorithm generates a new passcode and a previously stored passcode is replaced by said new passcode.

39. The electronic article surveillance apparatus of claim 28, further comprising:

a pull tab to facilitate the removal of said top panel and adjoining sections of said one or more sides.

* * * * *